United States Patent [19]

Holm

[11] Patent Number: 4,726,532

[45] Date of Patent: Feb. 23, 1988

[54] WEB REELING METHOD AND APPARATUS

[75] Inventor: Sakari Holm, Jyväskylä , Finland

[73] Assignee: Valmet Oy, Finland

[21] Appl. No.: 881,261

[22] Filed: Jul. 2, 1986

[30] Foreign Application Priority Data

Jul. 5, 1985 [FI] Finland ..... 85 2671

[51] Int. Cl.[4] ..... B65H 18/16; B65H 18/26

[52] U.S. Cl. ..... 242/65; 242/147 A

[58] Field of Search ..... 242/65, 147 A, 66; 226/93, 95; 100/93 RP, 163 A

[56] References Cited

U.S. PATENT DOCUMENTS 3,346,209 10/1967 Cronin ..... 242/66

4,179,330 12/1979 Page ..... 242/65 X

FOREIGN PATENT DOCUMENTS 2168040 11/1985 United Kingdom .

*Primary Examiner*—John M. Jillions

*Assistant Examiner*—Steven M. duBois

*Attorney, Agent, or Firm*—Steinberg & Raskin

[57] ABSTRACT

Method and apparatus for reeling a web, suitable in the reeling of paper web, wherein the web is introduced over the mantle of a reeling cylinder and passed onto a reeling shaft on which the web is reeled. The pressure level in a wedge-shaped inlet nip defined between the reeling cylinder mantle and the incoming run of the web is adjusted to eliminate or reduce the positive pressure which would otherwise exist in the nip by ejecting air from the nip by means of a blowing member situated in connection with the nip. Air jets are discharged from the blowing member in a direction opposite to the direction of movement of the surface of the reeling cylinder and/or opposite to the direction of movement of the incoming web run and by means of the air jets, air is ejected from the inlet nip to reduce the pressure therein.

11 Claims, 3 Drawing Figures

WEB REELING METHOD AND APPARATUS

BACKGROUND OF THE INVENTION

The invention relates generally to a method in paper web reeling apparatus wherein the web is introduced over the mantle of a reeling cylinder, which is preferably driven, and is then passed onto a reeling shaft on which the web is reeled into a roll.

The invention further relates to a paper web reeling apparatus comprising a driven reeling cylinder over which a web is introduced and then passed onto a reeling shaft on which the web is reeled.

One type of web reeling apparatus to which the invention is applicable is the so-called Pope-type reeling apparatus commonly used for reeling paper web as the web leaves, for example, a paper making machine, a coating machine, a supercalender or printing machine. The web is reeled onto a shaft to form a roll which is pressed against the Pope or reeling cylinder over a sector of which the web runs and which is rotatably driven so that its circumfenterial speed corresponds to the speed of the incoming web. Before the roll is completed, a new reeling shaft is brought into nip contact with the Pope cylinder so that the new reeling shaft begins to rotate at a corresponding circumferential speed. As soon as the paper roll is completed, i.e., obtains the desired diameter, it is shifted away from the Pope cylinder where upon its rotational speed begins to decrease resulting in the formation of a web loop between the new reeling shaft and the completed roll. The web loop is guided, for example, by means of a jet of compressed air, to wind around the new reeling shaft whereupon the web is torn from the completed roll.

A problem has been encountered in the reeling of certain paper qualities, for example, LWC and SC. In particular, in the case where a web of such paper qualities is introduced into the reeling apparatus at higher speeds, the web to be reeled tends to slide on the surface of the reeling cylinder. Such sliding particularly occurs in reeling apparatus of the type described above, i.e., wherein the new paper roll being formed on the reeling shaft is rotated through nip contact of the roll with the circumference of the driven reeling cylinder utilizing the friction force that exists between the paper web and the surface of the reeling cylinder. Thus, if the friction force is below a certain minimum value, the incoming paper web will slide on the surface of the reeling cylinder which results in uncontrolled variations in the web tension and hardness in the paper roll being formed. These variations in tightness and hardness produce wrinkles in the rolls and particularly at the inner layers of the rolls so that the innermost portions of the rolls are useless. This in turn results in considerable economic losses for the paper mill.

The extent to which the paper web slides over the surface of the reeling cylinder depends on several factors, such as the tightness with which the web is held against the surface of the reeling cylinder and the linear load produced by the primary and secondary forks which hold the paper roll being formed against the reeling cylinder. Moreover, the sliding is affected by the surface properties of the paper being reeled and of the reeling cylinder, i.e., by the coefficient of friction between the surfaces. The coefficient of friction is to a great extent determined by the introduction of air between the web and the surface of the reeling cylinder which tends to separate the web from the reeling cylinder.

The problem of sliding of the paper web on the surface of the reeling cylinder has in the past been treated by setting the tension of the paper web being introduced in the paper apparatus to be as high as possible through the adjustment of a speed differential between the reeling cylinder and the immediately preceeding drive unit from which the paper web leaves for introduction into the reeling apparatus. However, the amount to which the tension of the web can be increased is limited by the tendency of the web to break and by deterioration of the quality characteristics of the paper since, for example, the tensile strength and the "stretch at break" in the region of the break are thereby reduced.

Another technique used in attempting to prevent sliding between the web and the reeling cylinder surface is through increasing the linear loads between the roll being formed and the reeling cylinder to the maximum extent possible by using an excessively high loading force for the secondary or supporting forks by which the roll is pressed against the reeling cylinder. One drawback of this technique is that the quality characteristics of the paper deteriorate due to reductions in the tensile and the "stretch at break" of the web.

With respect to prior art related to the present invention, reference is made to Finnish patent application No. 84 3747 of Oy Kaukas Ab and Valmet Oy. A Pope-type reeling apparatus is disclosed wherein the paper roll being wound on a roll shaft is rotated through nip contact with the cirumference of the mantle of a reeling cylinder. In order to prevent sliding between the paper web and the mantle of the reeling cylinder, the interior of the reeling cylinder is maintained at a negative pressure within the sector of contact between the paper web and the reeling cylinder. By means of the negative pressure, the friction between the paper web and the surface of the mantle of the reeling cylinder is substantially increased since the pressure differential between the ambient atmosphere and the interior of the reeling cylinder causes the paper web to be held tightly against the surface of the reeling cylinder and, at the same time, removes any air which is wedged between the paper web and the cylinder surface.

During operation of conventional web reeling apparatus, air flow is induced into the wedge-shaped space or inlet nip defined between the incoming run of the web and the reeling cylinder mantle which creates a detrimental positive pressure in the inlet nip. This positive pressure is a result of the boundary-layer flows which are carried with the moving web and cylinder mantle. Due to the positive pressure nip, air flows between the web and the cylinder surface which reduces the friction between the web and cylinder. Moreover, air bubbles are formed which cause wrinkles in the web or which can even break the web.

The problems discussed above have increased as the speeds of paper machines have increased. For this reason, on-machine reeling apparatus have become one of the limiting factors preventing further increases in paper machine speeds. Moreover, these problems are particularly acute in the case of reeling coated papers which are slippery and impervious.

Another prior technique which has been used in an attempt to overcome the web sliding problem is the use of a grooved mantle for the reeling cylinder. It has been suggested that the air flow induced into the inlet nip can escape through the grooves so that no air bubbles are produced between the web and the cylinder surface. However, in order that the grooves will not cause marking of the web as it is reeled, it has been necessary to form the grooves with very small widths which, consequently, results in the grooves becoming blocked with paper fiber and dust. Accordingly, after a relatively short time, the grooves fail to operate as intended. To clean the grooves is a time consuming and difficult operation. For this reason, the provision of grooves on the reeling cylinder has not overcome the web sliding problem. Although the Pope cylinder construction described above in connection with Finnish application No. 84 3747 efficiently prevents the formation of an air layer between the web and the cylinder surface, the construction is quite expensive in manufacture.

SUMMARY OF THE INVENTION

Accordingly, it is an object of the present invention to provide new and improved web reeling apparatus by means of which it is possible to avoid the problems described above in an efficient and low cost manner.

Another object of the present invention is to provide new and improved methods and apparatus for web reeling which prevents entry of air between the web and the reeling cylinder to thereby improve the friction between the web and cylinder and to prevent formation of wrinkles in the web.

Still another object of the present invention is to provide new and improved methods and apparatus for web reeling by means of which the web can be introduced to the reeling apparatus with optimal tensioning. As noted above, it has been necessary to utilize excessively high tensioning for the web in order to keep the friction contact between the web and the cylinder surface at a satisfactory level.

A further object of the present invention is to provide new and improved web reeling apparatus and methods by means of which existing conventional reeling apparatus can be retrofit to avoid production of wrinkled broke paper, at least to the previous extent.

A still further object of the present invention is to provide new and improved methods and apparatus for reeling paper webs by which conventional reeling apparatus can be retrofit to provide increased speed capability.

Briefly, in accordance with the method of the present invention, these and other objects are obtained by controlling the pressure level which exists in the wedge-shaped inlet nip defined between the surface of the mantle of the reeling cylinder and the incoming run of the web immediately prior to the web contacting the reeling cylinder mantle. The pressure in the inlet nip is controlled in order to prevent or reduce the positive pressure which would otherwise exist in the inlet nip by ejecting air from the inlet nip. In an illustrated preferred embodiment, air is ejected from the inlet nip by means of a blowing member situated in connection with the inlet nip from which air jets are discharged in a direction opposite to the direction of movement of the surface of the reeling cylinder proximate to the blowing members and/or in a direction opposite to the direction of movement of the incoming web run. By means of the air jets discharged from the blowing member, air within the inlet nip is ejected therefrom to reduce or eliminate any positive pressure in the nip.

In accordance with the reeling apparatus of the invention, means for ejecting air from the inlet nip are provided. The air ejection means in a preferred embodiment comprises a blowing member situated at a location at which the web to be reeled is brought into contact with the mantle of the reeling cylinder. The blowing member includes one or more nozzle slots through which air jets are directed in a direction opposite to the direction of movement of the reeling cylinder mantle and/or opposite to the direction to which the incoming web run travels. The blowing member has an interior space which communicates with the nozzle slot or slots and which is connected to air blowing equipment via a duct.

By means of the method and apparatus of the invention, formation of a positive pressure in the inlet nip between the web to be reeled and the reeling cylinder is substantially prevented, and, in fact, it is even possible in some cases to create a negative pressure in the inlet nip which will further promote the adherance of the paper web to the surface of the reeling cylinder. Under these circumstances, it is no longer necessary to utilize a grooved reeling cylinder or expensive suction boxes within the reeling cylinder, or a perforated mantle for the reeling cylinder which would have a tendency to leave a marking on the surface of the web to be reeled.

Even though the invention is being described with reference to on-machine reeling devices, it will be understood that the invention is also suitable for use in off-machine reeling apparatus and in other post-treatment devices for paper in which problems that constitute the starting point for the present invention occur.

DETAILED DESCRIPTION OF THE DRAWINGS

A more complete appreciation of the present invention and many of the attendant advantages thereof can be readily understood by reference to the following detailed description when considered in connection with the accompanying drawings in which.

DESCRIPTION OF THE PREFERRED EMBODIMENTS

Figure 1:
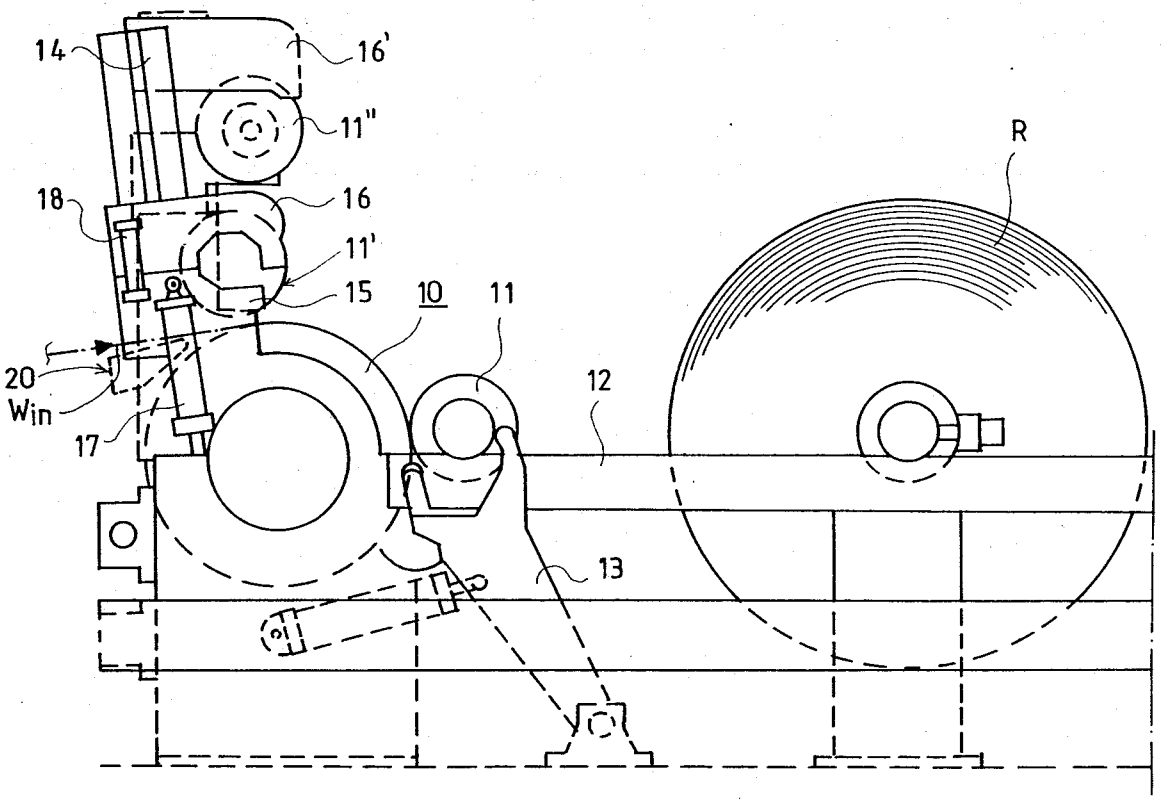
FIG. 1 is a schematic side elevation view of reeling apparatus to which the present invention can be applied.

Referring now to the drawings, wherein like reference characters designate identical or corresponding parts throughout the several views, and more particularly to FIG. 1, the major components of a Pope-type reeling apparatus include a reeling cylinder 10 over the circumference of which the paper web is carried over slightly more than one-quarter of a revolution before the web passes onto the circumference of a paper roll that is being formed around the roll shaft 11. The shaft 11 is rotatably supported on a pair of support rails 12 and secondary forks 13 urge the roll as it is being formed against the reeling cylinder 10. The secondary forks 13 also function to shift the completed paper roll away from the reeling cylinder 10 after the desired diameter of roll has been reached.

The completed rolls are carried along the support rails 12 to further treatment stations from where the empty roll shafts are returned such, for example, as onto storage rails (not shown) installed over the support rails 12.

A replacement device for the roll shafts 11 comprises guides 14 which project upwardly from the side of the reeling cylinder 10. The lower end of the guides 14 are pivotally mounted to the machine frame. The replacement device also comprises slidable jaws 15 and 16 which move up and down along each of the guides 14 so that the roll shaft 11' can be enclosed at its bearing portions in the jaw gap between the lower jaw 15 and the upper jaw 16. The guides 14, lower jaws 15 and upper jaws 16 constitute the so-called primary forks.

In the replacement of a roll shaft 11, the lower jaws 15 are raised to the level of the ends of auxiliary rails (not shown), while the upper jaws 16 are raised to their upper position at 16'. At the same time, the guides 14 are pivoted by means of hydraulic or pneumatic power units (not shown in FIG. 1) to a position at which no opening remains between the lower jaw 15 and the end of the auxiliary rail. The roll shaft 11" is permitted to roll into the gaps formed between the jaws which are closed by lowering the upper jaws 16'. The lower jaws 15 are then lowered so that the circumference of the roll shaft 11" is situated closely to the circumference of the reeling cylinder 10. After the guides 14 are pivoted in the direction of rotation of the reeling cylinder 10, and due to the eccentric journalling of the guides 14, the distance between the shaft 11' and the reeling cylinder 10 is further reduced until the shaft 11' comes into contact with the paper web running on the sector of the mantle of the reeling cylinder 10 whereby it obtains a circumferential speed that corresponds to the speed of the incoming web. The transfer of the web onto the new shaft can now be performed in the way described above and the new roll shaft can be lowered onto the support rails in place of the earlier shaft.

The construction and operation of the reeling apparatus described above are conventional and the instant description is intended to facilitate an understanding of the invention and its background. However, it is emphasized that the present invention is also applicable to different types of reeling apparatus as well as to off-machine apparatus whose construction and operation differ fundamentally from that described in conjunction with FIG. 1.

Figure 2:
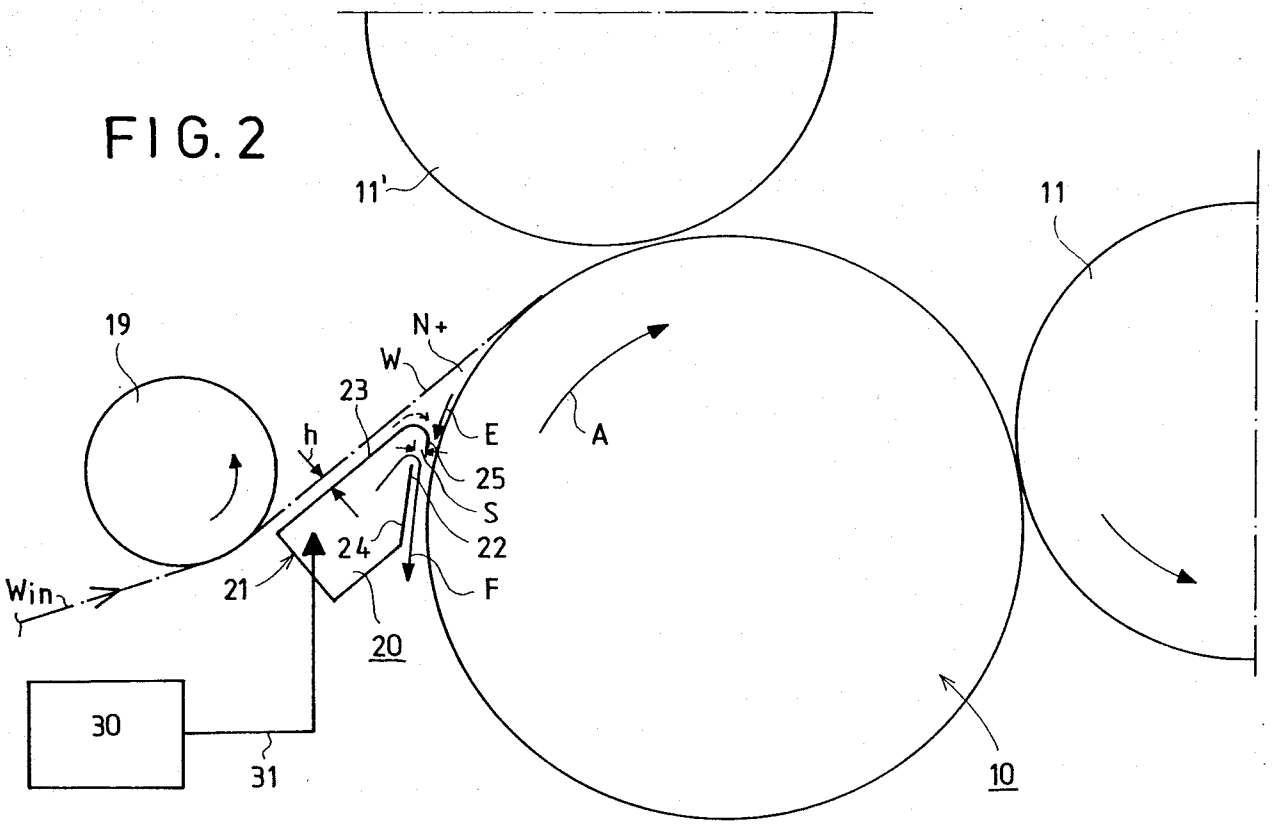
FIG. 2 is a schematic side elevation view of one embodiment of the invention.

Referring to FIG. 2, one embodiment of the invention is illustrated wherein a blow box 20 is situated in or proximate to the wedge-shaped space or inlet nip N+ which is defined by the incoming Web run on the one hand and by the mantle of the reeling cylinder 10 on the other hand. A positive pressure tends to be created in the nip N+ due to the surface of the reeling cylinder mantle rotating in the direction designated A which induces air to be carried into the nip N+. This air tends to "bubble" between the web and the cylinder 10 and is partly discharged from the sides of the nip N+.

The formation of a positive pressure in the nip N+ is prevented by means of an arrangement which, as illustrated in FIG. 2, comprises a blow box 20 having a substantially trapezoidal vertical section. The blow box 20 extends substantially over the entire width of the web and is defined by walls, generally designated 21, and a closed end. A first wall 24 is situated proximate and in opposed relationship to the surface of the reeling cylinder mantle. A nozzle slot 22 is provided in the first wall 24 and and a substantially planar or slightly curved wall 24 extends downstream from the nozzle slot 22 in the direction of the air jet F. The blow box 20 extends as far as possible into the nip N+ in view of the particular constructional limitations. The blow box 20 includes a second wall 23 opposite from the first wall 24. Wall 23 is substantially planar and has a surface which functions to guide the web onto the cylinder 10 to prevent fluttering of the web. The guide surface of wall 23 may even provide a smooth contact surface against which the web slides.

The paper web reeling apparatus includes the guide roll 19 over which the web passes prior to reaching the reeling cylinder. The guide surface of the second wall 23 of the blow box 20 extends substantially parallel to and is spaced a short distance h from a common plane which is tangential to both the guide roll 19 and the reeling cylinder 10.

An air jet F is discharged through the nozzle slot 22 and extends through a slot-like space defined between the wall 24 and surface of the reeling cylinder mantle. The air jet F has a direction which is opposite to the direction of rotation A of cylinder 10. The air jet F acts to eject air from the nip N+ as indicated by arrow E. Moreover, the blow box 20 functions to prevent air from having access to the nip N+. The blow box 20 is coupled to a source 30 of blowing air through a duct 31.

The width S of nozzle slot 22 is preferably in the range of between about 2 to 5 mm, and the speed of the air jets F in the nozzle slot 22 is preferably in the range of about 30 to 60 m/s.

Figure 3:
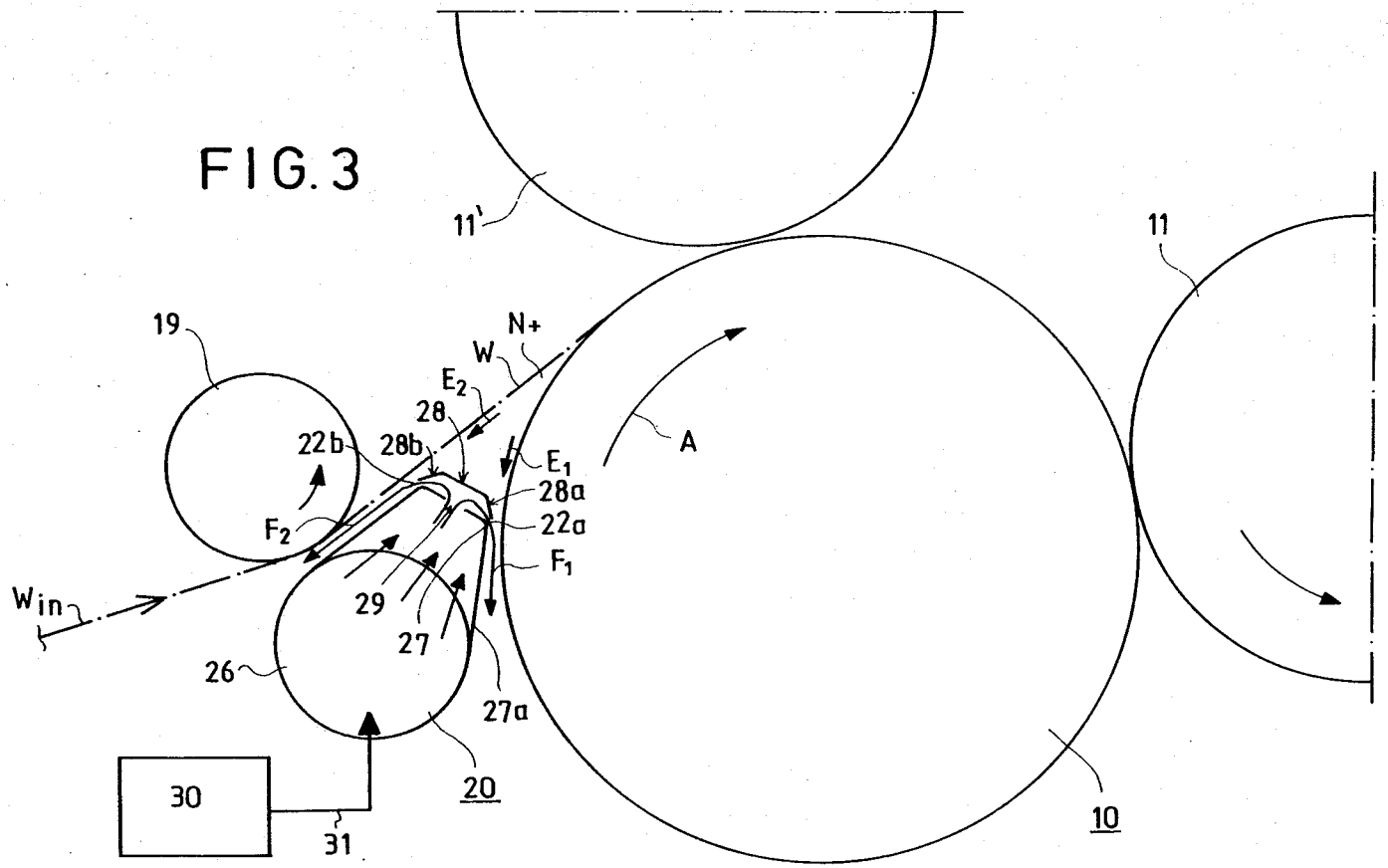
FIG. 3 is a view similar to FIG. 2 illustrating a second embodiment of the invention.

Referring to FIG. 3, another embodiment of the invention is illustrated wherein the blow box 20 comprises a tubular part 26 that extends substantially over the entire width of the web. A projecting part 27 extends from the tubular part 26 into the nip N+ and a blow slot 29 is provided at the end of the projecting part 27. A guide plate 28 is provided over the blow slot 29 which, together with the projecting part 27, defines two opposite nozzle slots, *22a* and *22b*. The projecting part of the blow box 20 includes a first wall *27a* which is situated proximate to the reeling cylinder 10 and defines a slot-like space. A second wall *27b* of projecting part 27 is situated proximate to the incoming run of the web and defines a second slot-like space therewith. The nozzle slots *22a* and *22b* direct air jets $F_1$ and $F_2$ through the first and second slot-like spaces in directions opposite to the directions of movement of the reeling cylinder mantle ($F_1$) and the incoming web run ($F_2$). The air jets $F_1$ and $F_2$ cause air to be ejected from the inlet nip N+ as designated by arrows $E_1$ and $E_2$ respectively and thereby prevent formation of a positive pressure in the nip N+. The blow box 20 prevents air from obtaining access into the nip N+. The air jet $F_2$ adjacent to the incoming web run may in some cases cause fluttering in the web so that in these cases the embodiment illustrated in FIG. 2 is preferable to that illustrated in FIG. 3. On the other hand, the arrangement of FIG. 3 prevents the formation of positive pressure in the nip N+ in a more efficient manner.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for improving the operation of web reeling apparatus including a reeling cylinder having a mantle and a reeling shaft on which a web is reeled into a roll, comprising the steps of:

introducing a web to be reeled as an open draw over said mantle of said reeling cylinder and passing the web from said reeling cylinder mantle onto said reeling shaft on which the web is reeled, said reeling cylinder and incoming open draw run of the web prior to contacting said mantle defining a wedge-shaped inlet nip; and ejecting air from said inlet nip to reduce the pressure therein by directing air jets from air blowing means situated in said inlet nip proximate to said reeling cylinder mantle in a direction substantially opposite to the direction of movement of said reeling cylinder mantle.

2. The method of claim 1 wherein said air ejecting step comprises the additional step of:

directing air jets from said air blowing means in a direction opposite to the direction of movement of said incoming open draw web run and proximate thereto.

3. The method of claim 1 wherein said reeling cylinder and the web roll being reeled on said roll shaft form a nip with each other, and wherein the roll being reeled on said roll shaft is rotated through nip contact with the circumference of said reeling cylinder which itself is rotatably driven.

4. A method for improving the operation of web reeling apparatus including a reeling cylinder having a mantle and a reeling shaft on which a web is reeled into a roll, comprising the steps of:

introducing a web to be reeled over said mantle of said reeling cylinder and passing the web from said reeling cylinder mantle onto said reeling shaft on which the web is reeled, said reeling cylinder and incoming run of the web prior to contacting said mantle defining a wedge-shaped inlet nip; and ejecting air from said inlet nip to reduce the pressure therein, said air ejecting step including a situating air blowing means in connection with said inlet nip, said air blowing means comprising a blowing member having a first wall in which nozzle means are provided proximate to said reeling cylinder mantle and a second wall situated proximate to said incoming run of the web, and wherein the method includes the further step of guiding the incoming run of the web over a guide surface of said blowing member as the web enters the inlet nip to stabilize the run thereof.

5. The method of claim 4 wherein said paper web reeling apparatus includes a guide roll over which the web passes prior to said reeling cylinder, and wherein said guide surface of said second wall of said blowing member is substantially planar and is situated substantially parallel to and spaced a short distance from a common plane which is tangential to both said guide roll and said reeling cylinder.

6. A method for improving the operation of web reeling apparatus including a reeling cylinder having a mantle and a reeling shaft on which a web is reeled into a roll, comprising the steps of:

introducing a web to be reeled over said mantle of said reeling cylinder and passing the wet from said reeling cylinder mantle onto said reeling shaft on which the web is reeled, said reeling cylinder and incoming run of the web prior to contacting said mantle defining a wedge-shaped inlet nip; and ejecting air from said inlet nip to reduce the pressure therein, said air ejecting step including situating air blowing means in connection with said inlet nip, said air blowing means comprising a blowing member having a first wall situated proximate to said reeling cylinder mantle defining a firt slot-like space therebetween, a second wall situated proximate to said incoming run of the web, defining a second slot-like space therebetween and a pair of nozzle means for directing air jets through said first and second slot-like spaces in directions opposite to the directions of movement of said reeling cylinder mantle and said incoming web run respectively whereby air is ejected from said inlet nip.

7. Web reeling apparatus, comprising:

a reeling cylinder having a mantle;

a reeling shaft on which a web is reeled into a roll, the web being introduced over said mantle of said reeling cylinder and passing from said reeling cylinder mantle onto said reeling shaft, said reeling cylinder mantle and an incoming run of the web prior to contacting said mantle defining a wedge-shaped inlet nip; and, air blowing means situated in connection with said inlet nip and adapted to communicate with a source of blowing air for directing air jets in at least one of a first direction opposite to the direction of movement of said reeling cylinder mantle and a second direction opposite to the direction of movement of said incoming web run, said air blowing means comprising a blow box including a first wall in opposed relationship to said reeling cylinder mantle defining a slot-like space therebetween, nozzle means provided in said first wall for directing air jets through said slot-like space in a direction opposite to the direction of movement of said reeling cylinder mantle, and a second wall having guide surface means situated proximate to said incoming run of the web for guiding and stabilizing the incoming run of the web, whereby air is ejected from said inlet nip to reduce the pressure therein.

8. The combination of claim 7 wherein said first wall of said blow box has a substantially planar surface downstream from said nozzle means in the direction of the air jets.

9. The combination of claim 7 wherein said reeling apparatus includes a guide roll over which the web passes prior to said reeling cylinder, and wherein said guide surface means comprises a substantially planar surface which is situated substantially parallel to and spaced a short distance from a common plane which is tangential to both said guide roll and said reeling cylinder.

10. Web reeling apparatus, comprising:

a reeling cylinder having a mantle;

a reeling shaft on which a web is reeled into a roll, the web being introduced over said mantle of said reeling cylinder and passing from said reeling cylinder mantle onto said reeling shaft, said reeling cylinder mantle and an incoming run of the web prior to contacting said mantle defining a wedge-shaped inlet nip; and, air blowing means situated is connection with said inlet nip and adapted to communicate with a source of blowing air for directing air jets in at least one of a first direction opposite to the direction of movement of said reeling cylinder mantle and a second direction opposite to the direction of movement of said incoming web run, said air blowing means comprising a blow box including a first wall situated proximate to said reeling cylinder mantle defining a first slot-like space therebetween, a second wall situated proximate to said incoming run or the web defining a second slot-like space therebetween, and a pair of nozzle means for directing air jets through said first and second slot-like spaces in direction opposite to the direction of movement of said reeling cylinder mantle and said incoming web run respectively, whereby air is ejected from said inlet nip to reduce the pressure therein.

11. The combination of claim 10 wherein said blow box includes a guide plate having a pair of opposite end portions which are in spaced opposed relationship to respective curved portions of said first and second walls of said blow box to define said pair of nozzle means.

* * * * *